United States Patent [19]

Cranskens et al.

[11] Patent Number: 4,764,842

[45] Date of Patent: Aug. 16, 1988

[54] PROCESS FOR THE ELECTROSTATIC CHARGING OF RECORDING MATERIALS AND APPARATUS FOR IMPLEMENTATION OF THE PROCESS

[75] Inventors: Georg Cranskens, Wedel; Erich Blume, Wiesbaden, both of Fed. Rep. of Germany

[73] Assignee: Hoechst Aktiengesellschaft, Frankfurt am Main, Fed. Rep. of Germany

[21] Appl. No.: 22,228

[22] Filed: Mar. 5, 1987

[30] Foreign Application Priority Data

Mar. 7, 1986 [DE] Fed. Rep. of Germany ..... 3607472

[51] Int. Cl.[4] ..... H01T 19/00; G03G 15/00

[52] U.S. Cl. ..... 361/225; 361/230; 361/213; 355/3 CH; 355/3 SH

[58] Field of Search ..... 355/3 CH, 3 DD, 3 BE, 355/3 SH, 14 SH; 361/225, 229, 230, 213, 214; 250/324–326

[56] References Cited

U.S. PATENT DOCUMENTS

| | | | |
|---|---|---|---|
| 2,576,882 | 11/1951 | Koole et al. | 361/214 X |
| 3,998,916 | 12/1976 | Van Turnhout | 361/230 X |
| 4,190,348 | 2/1980 | Friday | 250/325 X |
| 4,273,437 | 6/1981 | Neumann | 355/3 BE |
| 4,368,970 | 1/1983 | Hays | 355/3 DD |
| 4,374,616 | 2/1983 | Sasaki et al. | 355/3 CH |
| 4,531,828 | 7/1985 | Hoshino | 355/3 SH |

FOREIGN PATENT DOCUMENTS

| | | | |
|---|---|---|---|
| 0095217 | 11/1983 | European Pat. Off. | 361/230 |
| 0100643 | 2/1984 | European Pat. Off. | 361/230 |

*Primary Examiner*—Michael L. Gellner
*Assistant Examiner*—D. Rutledge
*Attorney, Agent, or Firm*—Foley & Lardner, Schwartz, Jeffery, Schwaab, Mack, Blumenthal & Evans

[57] ABSTRACT

A predetermined bending stress is applied in the direction of transport to a recording material, in particular a printing plate, which passes underneath a spray corona for electrostatic charging, the bending stress bringing about a flat contact of the printing plate on a supporting surface. This compensates for edge undulations of the printing plate caused during production. The charging apparatus has pairs of transport rollers which are arranged in front of and behind the supporting surface such that their nips for the printing plate lie above the supporting surface. Between each pair of transport rollers and the spray corona is attached a deflection roller which positively leads the printing plate down to the horizontal supporting surface at a first angle or lifts it up from the supporting surface at a second angle.

13 Claims, 6 Drawing Sheets

PROCESS FOR THE ELECTROSTATIC CHARGING OF RECORDING MATERIALS AND APPARATUS FOR IMPLEMENTATION OF THE PROCESS

BACKGROUND OF THE INVENTION

The invention relates to a process for the electrostatic charging of recording materials which pass underneath a spray corona, the recording materials being driven and supported by means of rollers, and an apparatus for implementation of the process.

Electrophotographic recording materials, such as printing plates, are usually charged by the plate being laid onto a flat table and sucked up against the table surface by means of a vacuum device and a charging device, such as, for example, a spray corona, and subsequently being moved over the printing plate at a constant distance from the table.

European Patent Application No. 0 100 643 describes an apparatus for the recording and electrophotographic development of partial images of a microfilm which includes three processing stations alongside one another. The first station charges the film and exposes the first partial image with a copy, the second station develops the electrostatic charge image, and the third station dries and fixes the toner image. During the individual process steps, the film to be exposed and developed lies in each case on a flat base and is not moved during the individual process step. The charging station consists of a single corona spray wire, on either side of which semi-cylindrical corona electrodes are arranged to effect a uniform configuration or distribution of the charges emanating from the spray corona wire.

A charging device of an electrophotographic unit is known from European preliminary published specification No. 0 095 217, in which the corona wire has the shape of a loop and runs between two rollers. The corona wire rotates at a speed greater than the speed of the photoconductor to be charged. The ends of the corona wire are tied together to form the loop and the tie is embedded in plastic, which surrounds it in the form of a bead. With this known charging apparatus there occurs a charging of the photoconductor, which is passed over the charging apparatus, which the loop of corona wire runs around. Special precautions are not taken to keep the distance between the photoconductor and the corona wire constant over the entire length of the charging apparatus.

U.S. Pat. No. 4,374,616 relates, inter alia, to a corona charging apparatus which can be moved back and forth over a recording material to be charged.

Apparatuses of this type operate satisfactorily and a good uniformity is achieved of the charge potential on the surface of the recording material to be charged, for example, a printing plate. Such corona charging apparatuses which can be moved back and forth are expensive and take up a great deal of space in a unit for the preparation of printing plates since they require guide rails and a reversible motor. The corona charging apparatus must be equipped with an advance and return, as a result of which the time for the necessary return is lost in the sequence for the preparation of the printing plate.

For reasons of time and cost savings, recently the charge-principle has been altered such that the recording material or the printing plate to be charged is passed underneath a stationary corona charging apparatus with the aid of transport rollers. In this arrangement, difficulties may occur to the extent that the constant distance required for a uniform charging between the printing plate and the corona charging apparatus with one or two wires depends on the dimensional and positional constancy (flatness) of the printing plate, the plate rigidity and the support possibilities underneath the corona charging apparatus. In particular, distance discrepancies due to undulations and insufficient support of the printing plates lead to unequal charge potentials on the printing plate. In particular, errors of this type occur to a very great extent whenever the printing plates have edge undulations. Dimensional and positional discrepancies of up to about 2 mm with respect to the evenness of the printing plates keep recurring on account of edge undulations, even in the case of good plate production, and can only be avoided with great effort and a correspondingly high reject level of defective plates. Even if the printing plates are guided over flat supporting surfaces or tables, an uneven charge distribution on account of the edge undulations of the printing plates cannot be avoided.

SUMMARY OF THE INVENTION

The object of the present invention is to provide a method for the electrostatic charging of recording materials.

A further object of the present invention is to provide a method of electrostatically charging recording materials so that a substantially even charging of recording materials, which have edge undulations caused by the production process for the preparation of the recording materials, is assured.

This object is achieved according to the present invention in that the recording materials are set in the direction of transport under a predetermined bending stress and are passed in this condition flatly through a region underneath a spray corona. Due to the fact that the recording materials, in particular printing plates, are passed with a certain bending stress over a flat surface underneath the spray corona, they come to lie completely flat against the supporting surface in spite of the existing edge undulations, so that the distance between the spray corona and the recording material, considered over its entire area, is constant.

Another object of the present invention is to provide an apparatus for electrostatically charging recording materials.

A further object of the present invention is to provide an apparatus having the advantage of making edge undulations of the recording material to be charged lie flat on a supporting means by the positive guidance of the recording material over the supporting means, so that there is a constant distance between the recording material and a charging means.

This object is achieved by an apparatus comprising: transport means for transporting the recording materials; support means for supporting the recording materials during transport; deflection means for deflecting the recording materials to a surface of the support means and imparting a bending stress on the recording materials to bring about flat contact of the recording materials on the support means; and charging means for electrostatically charging the recording materials as they are transported across the support means.

In a preferred embodiment, the apparatus comprises pairs of transport rollers that are arranged in front of and behind the supporting surface such that their nips for the recording material lie above the supporting surface and such that there is a deflection roller or a pair of deflection rollers in each case between the pairs of transport rollers and the spray corona and the deflection roller or rollers lead the recording material down to the horizontal supporting surface at a first angle or lift it up from the supporting surface at a second angle.

Further objects and advantages will become apparent from the following detailed description of the preferred embodiments.

BRIEF DESCRIPTION OF THE DRAWINGS

The present invention is described in more detail below with reference to exemplary embodiments shown in the form of drawings, in which.

DETAILED DESCRIPTION OF THE PREFERRED EMBODIMENTS

Figure 1:
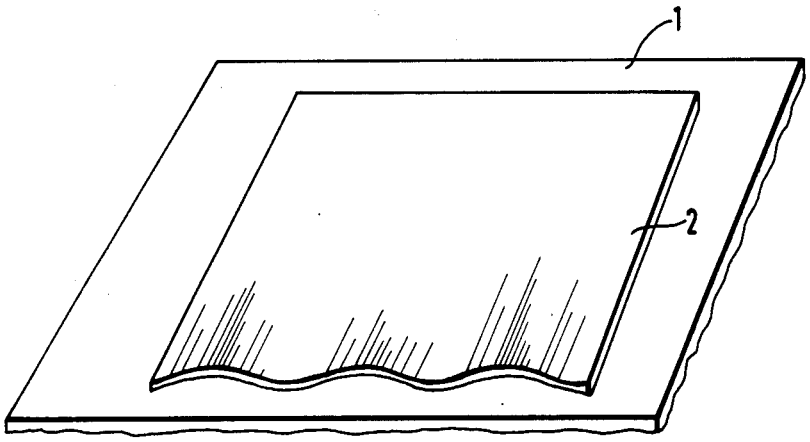
FIG. 1 shows, in a diagrammatic perspective view, exaggerated edge undulations of a printing plate which lies on a flat surface.

FIG. 1 shows a printing plate 2 with an edge undulation, shown exaggerated, lying on a flat supporting surface 1. The edge undulations of printing plates caused by the conventional preparation process are of an order of magnitude of up to 2 mm. If no force is exerted on the printing plate 2, the weight of the printing plate 2 itself is not sufficient to make this edge undulation disappear.

Figure 2:
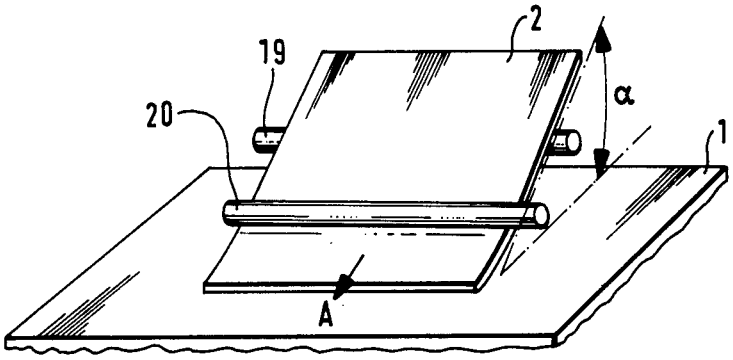
FIG. 2 shows a trial arrangement for the application of a bending stress to a printing plate which is moved over a flat supporting surface.

FIG. 2 shows a diagrammatic representation of a trial set-up, in which a bending stress is applied to a recording material 2, in particular, a printing plate. For this purpose, the recording material 2 is guided at an angle $\alpha$ to a horizontal flat supporting surface 1 and pushed over the supporting surface 1 in the direction of arrow A. The reverse of the recording material 2 is guided during this process over a support roller 19, while the front of the printing plate is passed around a deflection roller 20 which positively feeds the recording material 2 to the flat supporting surface 1 at the angle $\alpha$. The recording material 2 comes down on the supporting surface 1 at the angle $\alpha$ and is deflected into the horizontal plane of the supporting surface 1, a bending stress being built up in the recording material 2 in the direction of the arrow A ensuring that the recording material 2 lies flat against the supporting surface 1 and that the edge undulations are smooth. The flat position and the contact against the supporting surface 1 are preserved for a sufficient section along the supporting surface.

Figure 3:
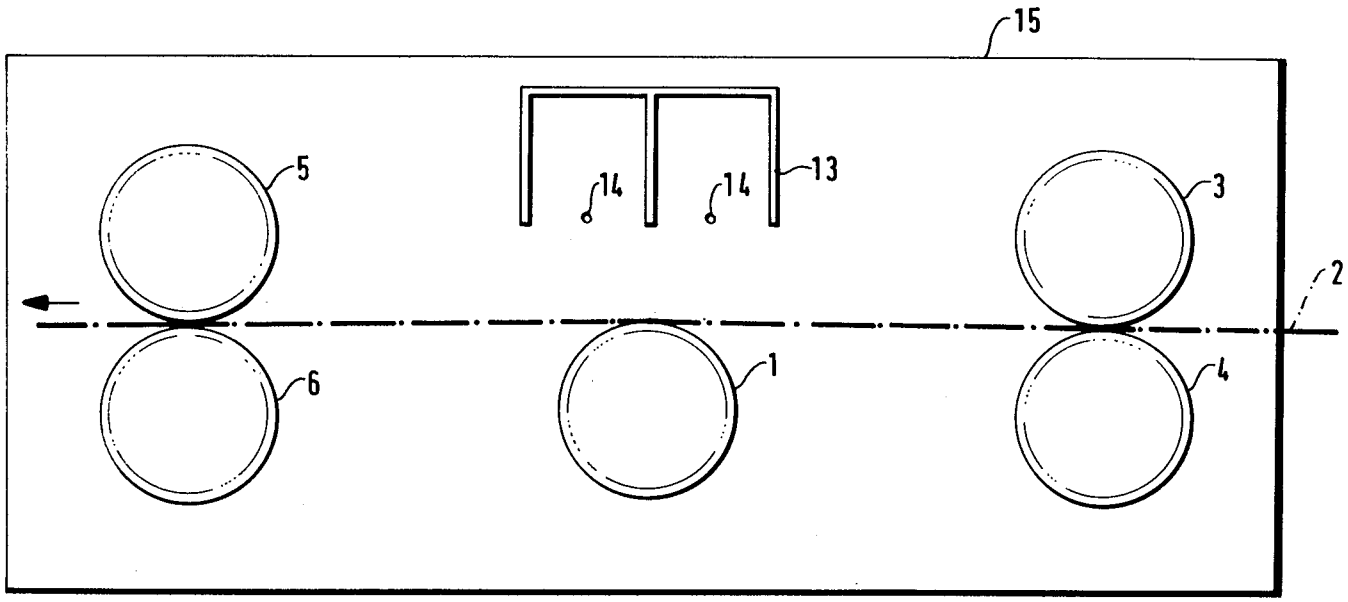
FIG. 3 shows a diagrammatic side view of a conventional charging apparatus for printing plates.

FIG. 3 shows a conventional charging apparatus in which a spray corona 13 with two spray wires 14,14 is mounted between two side plates 15,15. A recording material 2, indicated by dot-dashed lines, is passed self-supported underneath the spray corona 13 by pairs of transport rollers 3,4 and 5,6, which are arranged on either side of the spray corona 13, the only support being provided by the roller-shaped supporting surface 1. It is obvious that the more or less linear contact of the recording material 2 on the roller-shaped supporting surface 1 will result in sagging of the recording material in the sections between the supporting surface 1 and the first pair of transport rollers 3,4 on the one hand, and the second pair of transport rollers 5,6 on the other hand. These distance discrepancies produce uneven charge potentials on the recording material 2. Even if the roller-shaped supporting surface 1 is replaced by a flat supporting surface, the uneven charge potential distribution on the recording material 2 cannot be completely eliminated since the edge undulations of the recording materials, which generally always exist as described before with reference to FIG. 1, bring about distance discrepancies between the spray corona and the surfaces of the recording materials.

Figure 4:
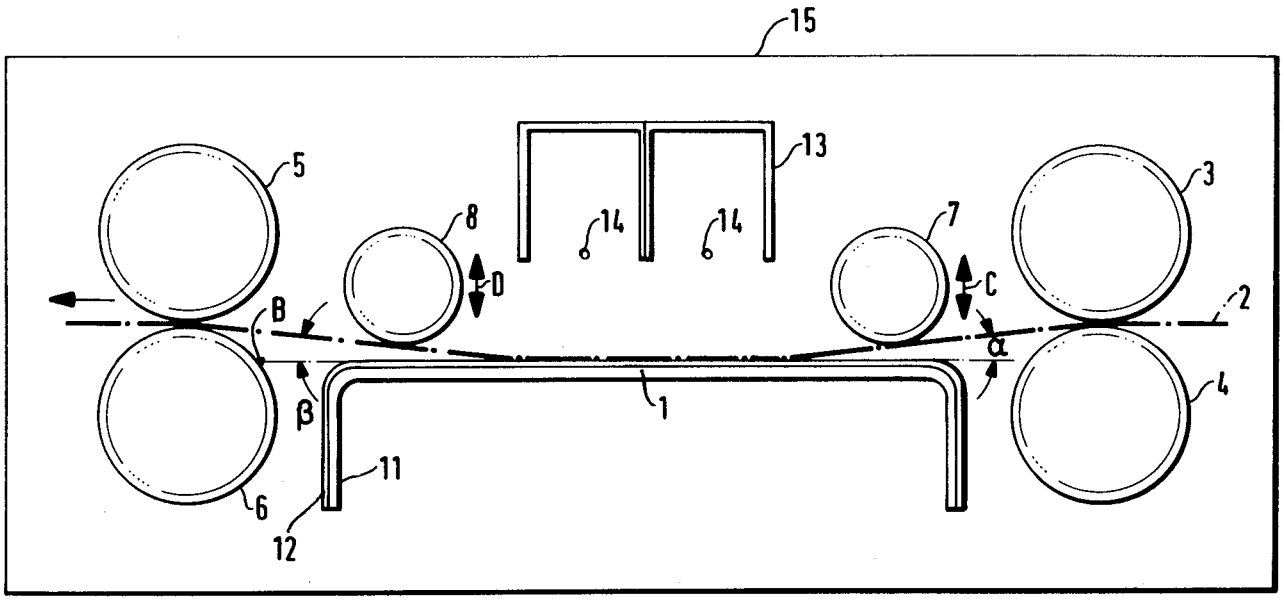
FIG. 4 shows a diagrammatic side representation of a first embodiment of the apparatus according to the present invention.

These difficulties are eliminated by the first embodiment of the apparatus according to the present invention shown diagrammatically in FIG. 4. This embodiment uses the principle described with reference to FIG. 2, according to which a bending stress is applied to the recording material. A recording material 2, still referred to here as "printing plate", is passed through the pair of transport rollers 3,4 and positively fed by a first deflection roller 7 to the flat supporting surface 1 at an angle of inclination $\alpha$. The first deflection roller 7 presses onto the topside of the printing plate 2, which comes down on the flat supporting surface and is deflected into the horizontal. The positive guidance causes a bending stress to be applied to the printing plate 2 which presses the edge undulations flat during the forward movement on the flat supporting surface 1. Lying flat on the supporting surface 1, the printing plate 2 is passed underneath the spray corona 13 and thereby charged by the two spray wires 14,14 of the spray corona 13, which are at a distance of up to 18 mm from the printing plate 2. At the delivery of the supporting surface 1, the leading edge of the printing plate 2 meets the lower transport roller of the pair of transport rollers 5,6 at point $\beta$ and is raised and bent upward with respect to the horizontal at an angle $\beta$ via a second deflection roller 8. The pair of transport rollers 5,6 undertakes the further transport of the printing plate 2. The bending stress necessary for laying flat and contacting the printing plate 2 is thus preserved from start to finish in the section of the printing plate extending underneath the spray corona 13. After the charging section, the printing plate 2 can thus be lifted off of the flat supporting surface 1 in the same way at the angle $\beta$, which is equal to the angle $\alpha$, and transported away, the necessary bending stress for smoothing of the edge undulations of the printing plate being preserved for the rear portion of the printing plate 2 as well.

The flat supporting surface 1 is formed by a sheet bent in the shape of a U. To avoid scratches on the aluminium reverse of the printing plate 2 during its passage, the supporting surface 1 is coated, for example, with a protective fabric 12 of polyamide. The same purpose is also achieved if the supporting surface 1 is made of a hard-chrome plated sheet of steel or consists of a sheet of dimpled special steel.

The angles $\alpha$ and $\beta$ lie in the range from 4° to 9° and, in particular, in the range between 6° and 8°. The distance between the supporting surface 1 and the deflection rollers 7 and 8 is greater than the thickness of the printing plate 2 and is generally 1 to 2 mm. The distance mentioned above is with reference to the lowest point of each deflection roller 7,8.

The pairs of transport rollers 3,4 and 5,6 are arranged such that their nips for the printing plate 2 lie above the supporting surface 1 and higher than the lowest point of the deflection rollers 7 and 8. The deflection rollers 7,8 are located above and near the downwardly bent limbs 11 of the horizontal section of the supporting surface 1. As the double-headed arrows C and D indicate, the deflection rollers 7 and 8 are vertically displaceable, so that their distance from the supporting surface 1 is selectable within certain limits. On the one hand, this makes possible an adaptation to different thicknesses of the printing plates 2 and, on the other hand, it also means that the bending stress to be applied can be chosen according to the respective edge undulation of the printing plate 2 such that the flat position of the printing plate 2 on the supporting surface 1 is assured.

Figure 5:
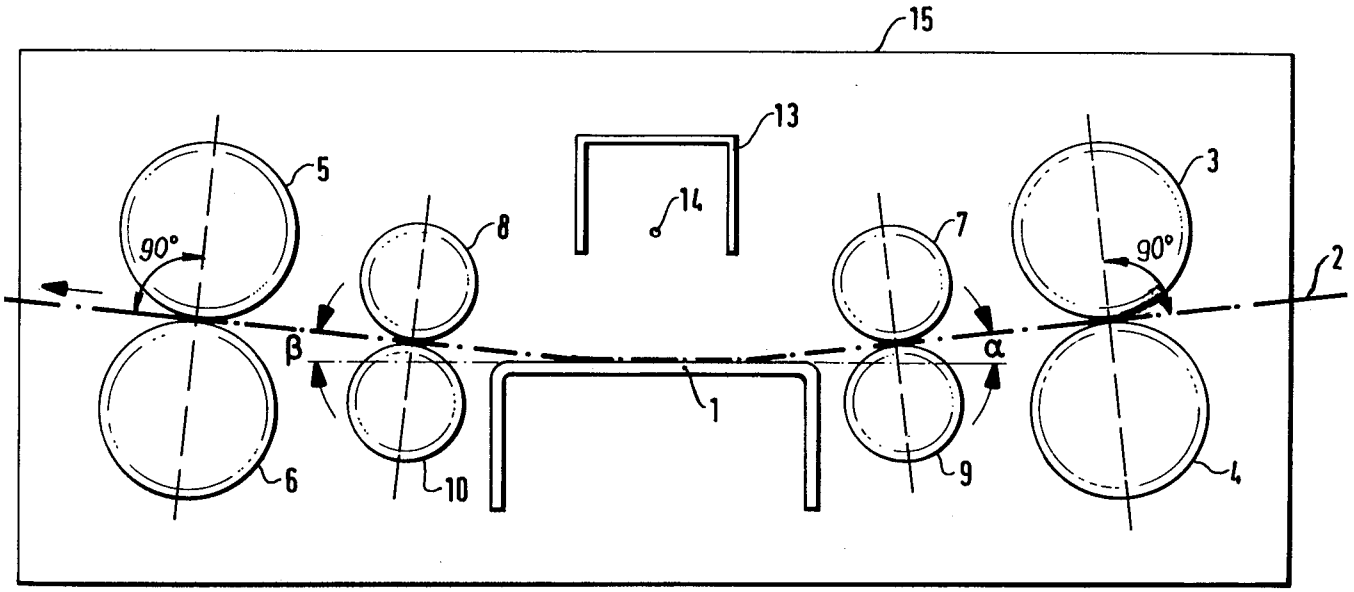
FIG. 5 shows a diagrammatic sectional view of a second embodiment of the apparatus according to the present invention.

FIG. 5 shows a modified embodiment of the apparatus according to the present invention in which a pair of deflection rollers is provided in each case instead of an individual deflection roller. In this embodiment, the printing plate 2 is likewise positively fed to the supporting surface 1 at the angle $\alpha$ through the pair of transport rollers 3,4 and the pair of deflection rollers 7,9 and positively transported further through the further pair of transport rollers 8,10 and the further pair of deflection rollers 5,6, at the angle $\beta$, after leaving the supporting surface 1. Deviating from the embodiment according to FIG. 4, in which the spray corona 13 is a two-wire corotron, in this embodiment the charging is carried out by a spray corona 13 with a single spray wire 14. This means that the charging section can be shortened, and thus also the supporting surface 1, as a result of which reliable, flat contact against the supporting surface 1 is easier to bring about. In this embodiment, the pairs of deflection rollers 7,9; 8,10 are arranged on either side of the U-shaped bent supporting surface 1. The joining lines through the center points of the pair of transport rollers 3,4 and the pair of deflection rollers 7,9 are parallel to each other and run perpendicular to the recording material 2. The same applies analogously to the joining lines of the further pair of transport rollers 5,6 and of the pair of deflection rollers 8,10.

Figure 6:
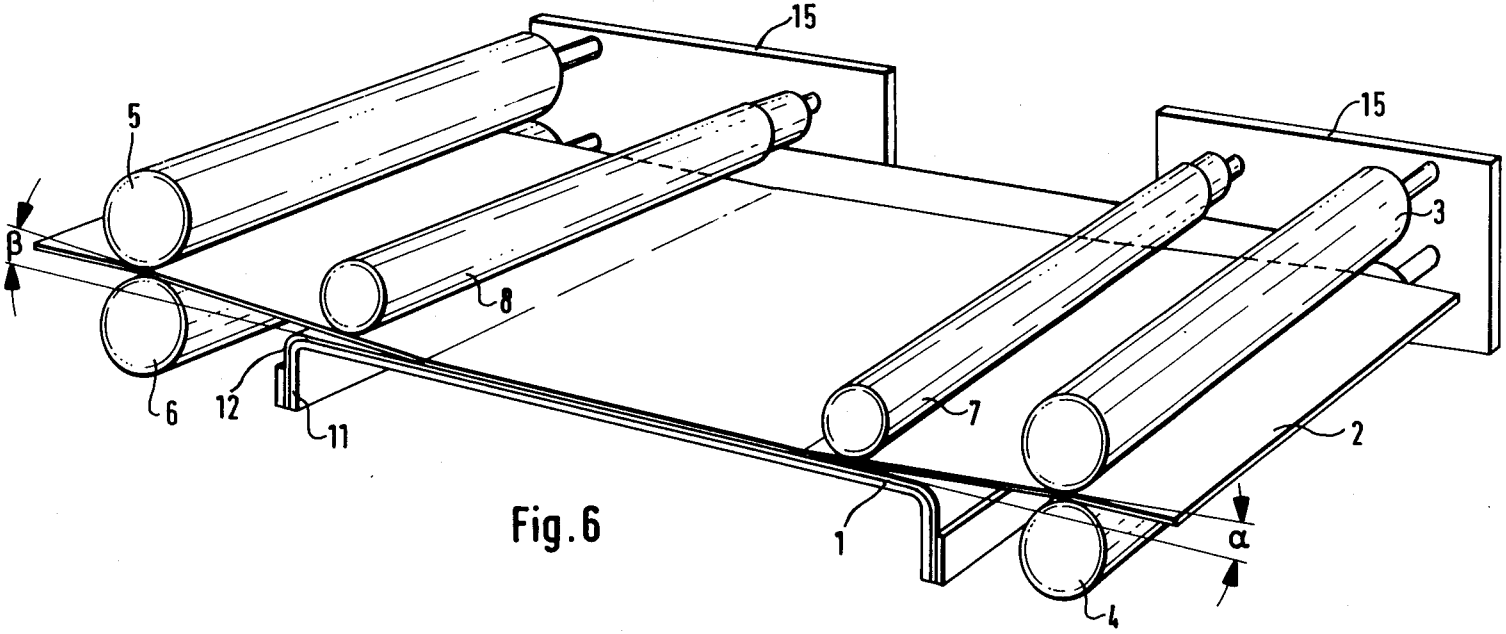
FIG. 6 shows a perspective view of the embodiment according to FIG. 4.

FIG. 6 shows a perspective view of the apparatus according to FIG. 4, the printing plate 2 passing through being shown in its middle position, i.e. symmetrical to the spray corona (not shown). In FIG. 6 only the rear side plates 15,15 can be seen, while the front side plates have been omitted for reasons of clarity. The rollers are in each case mounted by their spindles in the side plates 15,15.

Figure 7:
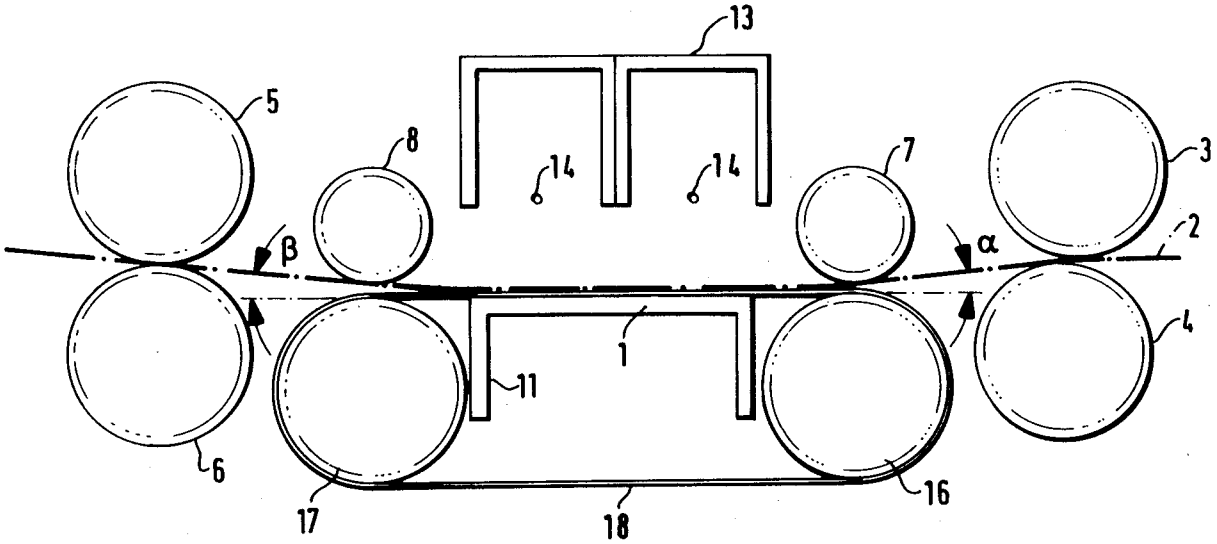
FIG. 7 shows a diagrammatic sectional view of a third embodiment of the apparatus according to the present invention.

FIG. 7 shows a further embodiment of the apparatus according to the invention which is designed similarly to the embodiment according to FIG. 4, with the addition of a driven endless conveyor belt 18 running around rollers 16,17 and over the supporting surface 1. Instead of a single conveyor belt 18, a number of narrow, adjacent conveyor belts may be used. The drive of the conveyor belt or belts 18 is accomplished via one of the rollers 16 or 17, the other serving only as a deflection roller. The conveyor belt or belts 18 have the effect of avoiding scraping of the printing plate 2 on the supporting surface 1, thus avoiding scratching the reverse of the printing plate 2, and furthermore facilitate the passage of the printing plate 2.

The rollers 16,17 are arranged underneath the deflection rollers 7,8 such that their highest point in each case lies in the extended plane of the horizontal section of the supporting surface 1.

What is claimed is:

1. Apparatus for the electrostatic charging of recording materials, said apparatus comprising:

(a) transport means for transporting the recording materials to be charged in the direction of a charging means;

(b) plane support means for supporting the recording materials during transport;

(c) deflection means for deflecting down the recording materials to a horizontal surface of the plane support means located underneath the charging means and imparting a bending stress in the direction of transport on the recording materials to bring about flat contact of the recording materials on the plane support means; and (d) said charging means for electrostatically charging the recording materials as they are passed flatly over the horizontal surface of said plane support means located underneath said charging means;

wherein the transport means comprises transport rollers arranged in front of and behind the support means such that their nips for the recording material lie above the support means, the deflection means comprises deflection rollers between the transport rollers and the support means for deflecting the recording materials down to the support means at a first angle and lifting off the recording materials from the support means at a second angle, and the charging means comprises a spray corona.

2. Apparatus according to claim 1, wherein the first and second angles are of equal size.

3. Apparatus according to claim 1, wherein the first and second angles are between 4° and 9°.

4. Apparatus according to claim 3, wherein the first and second angles are between 6° and 8°.

5. Apparatus according to claim 1, wherein the distance between the support means and the lowest point of each deflection roller is greater than the thickness of the recording material.

6. Apparatus according to claim 1, wherein the distance between the support means and the lowest point of the deflection roller is 1 to 2 mm.

7. Apparatus according to claim 1, wherein the support means is a support surface bent in the shape of a U and the deflection rollers are arranged above and near the downwardly bent limbs of a horizontal section of the supporting surface and are displaceable vertically with respect to the horizontal section.

8. Apparatus according to claim 7, wherein the supporting surface is coated with a protective fabric.

9. Apparatus according to claim 7, wherein the deflection rollers comprise pairs of rollers arranged on either side of the U-shaped, bent supporting surface and such that a joining line through the center points of a pair of rollers runs parallel to the joining line of the neighboring transport rollers and perpendicular to the recording material.

10. Apparatus according to claim 1, wherein the spray corona is a two-wire corotron and the recording material transported completely flat over a horizontal section of the support means is taken past spray wires of the corotron at a distance of up to 18 mm.

11. Apparatus according to claim 1, wherein the spray corona is a corotron with a single spray wire.

12. Apparatus according to claim 1, wherein the support means is a support surface bent in the shape of a U, the deflection rollers are arranged outside and above a horizontal section of the supporting surface, and a plurality of conveyor belts runs endlessly around conveyor rollers to pass over a horizontal section of the support surface.

13. Apparatus according to claim 12, wherein the conveyor rollers are arranged underneath the deflection rollers such that their highest point in each case lies in the extended plane of the horizontal section of the supporting surface, and wherein one of the conveyor rollers is driven.

* * * * *